US007345259B2

(12) United States Patent
Bauer et al.

(10) Patent No.: US 7,345,259 B2
(45) Date of Patent: Mar. 18, 2008

(54) CIRCUIT ARRANGEMENT AND METHOD FOR PREVENTING OVERHEATING OF A COOKING APPLIANCE

(75) Inventors: Hans-Jürgen Bauer, Traunstein (DE); Robert Hasslberger, Ruhpolding (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 11/599,499

(22) Filed: Nov. 13, 2006

(65) Prior Publication Data

US 2007/0125763 A1 Jun. 7, 2007

(30) Foreign Application Priority Data

Nov. 28, 2005 (DE) ..... 10 2005 056 708

(51) Int. Cl.
*H05B 1/02* (2006.01)
*F27D 11/00* (2006.01)

(52) U.S. Cl. ..... 219/494; 219/444.1; 219/457.1; 219/458.1; 219/507; 219/508; 219/519; 219/465.1; 219/497; 219/448.11; 219/448.13; 219/448.16; 219/448.18

(58) Field of Classification Search ..... 219/441, 219/494, 457.1, 458.1, 507–8, 519, 465.1, 219/497, 448.11–448.13, 448.16, 448.18
See application file for complete search history.

(56) References Cited

U.S. PATENT DOCUMENTS 4,755,655 A * 7/1988 Reiche et al. ..... 219/448.11
5,347,104 A 9/1994 Morishima et al.

FOREIGN PATENT DOCUMENTS

| | | |
|---|---|---|
| DE | 27 34 283 | 2/1978 |
| DE | 35 35 743 | 4/1987 |
| DE | 196 30 031 | 1/1998 |
| EP | 0 786 923 | 7/1997 |
| WO | WO 2005/027577 | 3/2005 |
| WO | WO 2005/074321 | 8/2005 |

OTHER PUBLICATIONS

National Search Report DE 10 2005 056 708.8, Nov. 28, 2005.

* cited by examiner

*Primary Examiner*—Shawntina Fuqua
(74) *Attorney, Agent, or Firm*—Russell W. Warnock; James E. Howard

(57) ABSTRACT

The invention relates to a method and a circuit arrangement for preventing overheating of a cooking appliance. The arrangement includes a power circuit with a heating element and a control circuit with a coupling switch. The control circuit and the power circuit are coupled by the coupling switch. The arrangement further includes a safety switch to the control circuit. The coupling switch interrupts a power supply to the power circuit to the heating element when a limiting temperature in the cooking appliance is exceeded.

11 Claims, 1 Drawing Sheet

CIRCUIT ARRANGEMENT AND METHOD FOR PREVENTING OVERHEATING OF A COOKING APPLIANCE

Figure 1:
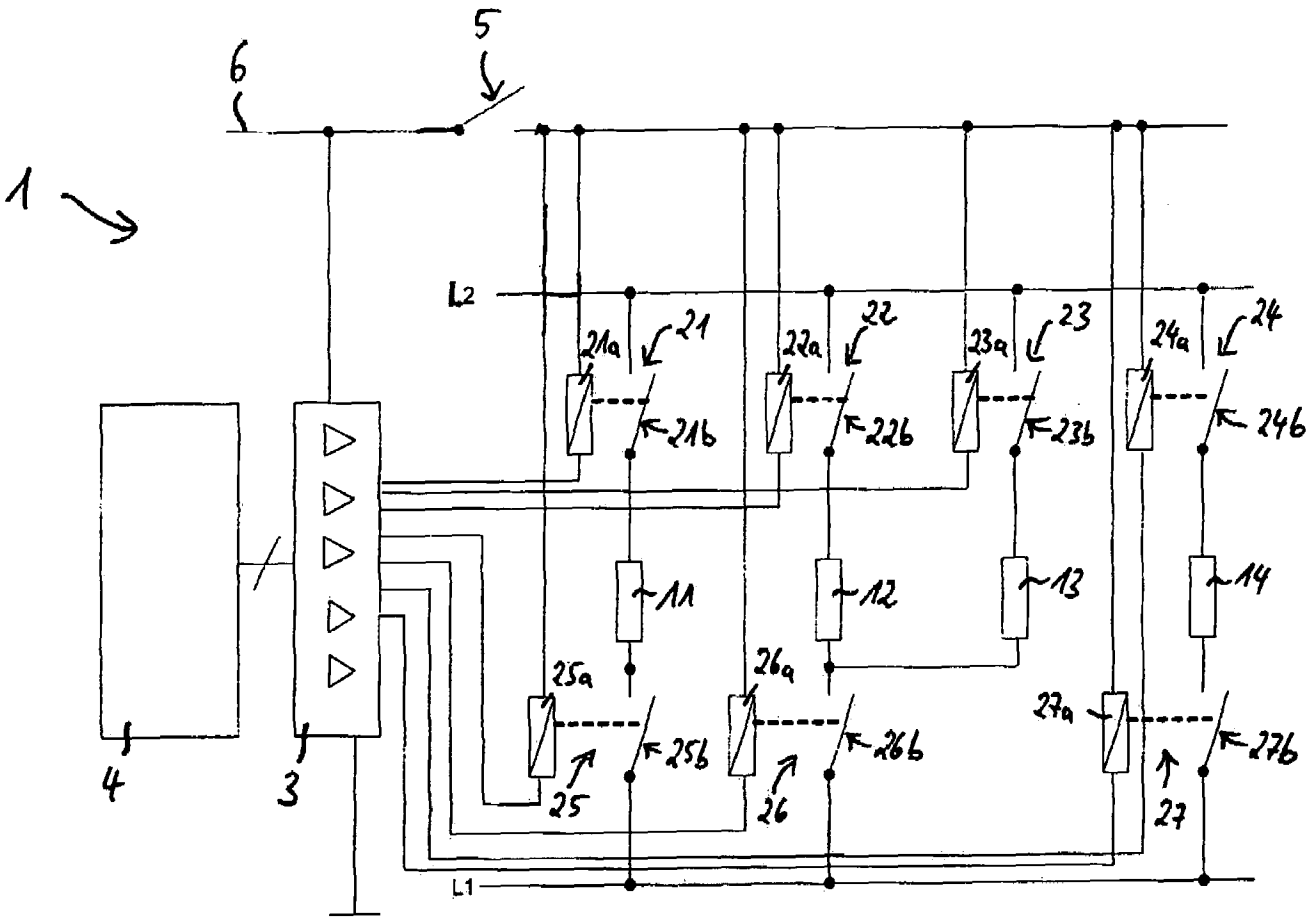

The invention relates to a circuit arrangement for preventing overheating of a cooking appliance, wherein the circuit arrangement comprises a power circuit in which at least one heating element is connected and a control circuit for controlling a coupling switch. The control circuit and the power circuit are electrically coupled by means of at least one coupling switch. The invention also relates to a method for preventing overheating of such a cooking appliance.

German Unexamined Laid-Open Patent Application DE 35 35 743 A1 discloses a cut-out protection device for electric cookers for preventing overheating. Temperature sensors and temperature monitors are installed underneath the hotplates in the electric cooker. The hotplates are connected into a power circuit of the electric cooker. Relays and contactors for interrupting the electric circuit are also connected into this power circuit. If overheating of the hotplates occurs, the electric circuit or the power circuit are interrupted by the contactor and the electric cooker is switched off.

Overheating protection for electric cookers is further known from the German Unexamined Laid-Open Patent Application DE 196 30 031 A1. Hotplates or heating plates of the electric cooker are supplied with power via a plurality of electric leads of a power circuit. A relay which can actuate the switches disposed in the other electric leads is connected into a main lead. The switches in the other leads are embodied as thermally fusible links, and when there is a risk caused by overheating of the cooker, these thermally fusible links are activated by the relays and then all the other leads used to operate the cooker are immediately shut off. An important disadvantage of the known circuit arrangements for preventing any overheating of an electric cooker can be seen in that the temperature protection limiters are arranged in a power circuit in which relatively high electric currents flow. As a result of these relatively high electric currents, these temperature protection limiters must be designed in such a manner than they do not exhibit too-high self heating and they can switch these relatively high electric currents. On the one hand, this is relatively costly and on the other hand, this results in temperature protection limiters which are embodied as relatively large. In addition, the temperature protection limiters in a cooking appliance, in particular an electric cooker, must be designed for a current intensity which generally corresponds to the total power of all or substantially all the heating elements of the cooking appliance.

It is thus the object of the present invention to provide a circuit arrangement and a method for preventing overheating of a cooking appliance which can be achieved at low expense and which reliably prevents overheating.

This object is achieved by a circuit arrangement which has the features according to claim 1 and a method which has the features according to claim 10.

A circuit arrangement according to the invention for preventing overheating of a cooking appliance comprises a power circuit and a control circuit. At least one heating element of the cooking appliance is connected into the power circuits. At least one coupling switch is connected into the control circuit, the control circuit and the power circuit being electrically coupled by means of the coupling switch. The control circuit is embodied to control the coupling switch. An essential idea of the invention is that a safety switch is connected into the control circuit, wherein the safety switch can be actuated depending on the temperature in the cooking appliance in such a manner when a limiting temperature in the cooking appliance is exceeded, the power supply via the power circuit to the heating element is interrupted by the coupling switch. In this case, the power supply circuit of the heating elements is designated as the power circuit. The separate circuit designated for controlling the coupling element is designated as the control circuit. Since significantly lower currents flow in the control circuit compared with the power circuit, a safety switch with significantly reduced requirements with regard to the electric currents to be switched can be used in the invention. The circuit arrangement can thereby be achieved simply and at low expense.

Since the safety switch in the circuit arrangement according to the invention can have substantially smaller dimensions compared to the safety switches known from the prior art (in particular with regard to the electric currents to be switched), smaller and less expensive safety switches can therefore be used. Since the safety switch is disposed in the control circuit, less self-heating of the safety switch also occurs (lower currents), accompanied by longer stability with regard to the switch-off temperature of the safety switch. Not least, the smaller dimensions of this type of safety switch make it possible to achieve more flexibility in the positioning and arrangement.

The coupling switch is advantageously embodied as a relay. Two coupling switches are preferably connected into the control circuit, the control circuit being electrically coupled to the power circuit by means of the two coupling switches. Since the power supply to a heating element via the control circuit can be adjusted by means of two coupling switches, a redundant system can be provided for safety with regard to overheating of the cooking appliance. If a so-called "relay freeze" (switching contact remains suspended) occurs at a coupling switch, in particular if it is embodied as a relay, the power supply to the heating element can still be interrupted via the second coupling switch.

When the cooking appliance is operating normally, the two coupling switches can advantageously be controlled via a control unit and individual operation of the heating element can be adjusted depending on the control of the coupling switch. The control unit is preferably connected into the control circuit. A driver unit connected into the control circuit is advantageously controlled by the control unit, the driver unit being connected between the control unit and the coupling switch. It can be provided that one of the two coupling switches is embodied as a time-control coupling switch. The power to be supplied to the heating element via the power circuit can thereby be synchronized in time. The second coupling switch can be designed to adjust the operating mode or the heating mode of the heating element. In this case, it can be provided, for example that a power to be supplied via the power circuit is increased.

Normal operation of the cooking appliance is understood as that mode in which the coupling switches can be controlled correctly and free from error and no failure of the electronic control and/or regulation of the coupling switches and/or the heating elements occurs. In addition, correct and error-free operation of temperature sensors or temperature probes for monitoring the temperature of the heating elements is also understood during such normal operation.

The coupling switch preferably comprises a coil. The safety switch is preferably electrically connected to the coil of the coupling switch and the power supply to the coil can be controlled depending on the actuation of the safety switch. It can thus be achieved that the heating elements in the power circuit are not switched directly by the safety switch but the coil of the coupling switch disposed in the control circuit can be influenced. The safety switch therefore actuates those elements of the coupling switch triggering the heating element, which are connected in the control circuit.

A switching contact of the coupling switch is advantageously connected into the power circuit and can be actuated in such a manner that when the limiting temperature is exceeded, the switching contact is opened, by opening the safety switch and interrupting the power supply to the coil. The coupling switch thus has a relatively simple structure and makes it possible to achieve secure electrical coupling of the control circuit to the power circuit. In addition, it can thus be achieved in a reliable and inexpensive manner that in the event of an impending overheating of the heating elements or the cooking appliance, the switching contact can be opened rapidly by interrupting the power supply to the coil by opening the safety switch.

It can be provided that at least two heating elements are connected into the power circuit and at least two coupling switches are connected in the control circuit, which are electrically connected to a control unit. Advantageously, if two heating elements are provided in the power circuit, four coupling switches are connected in the control circuit, whereby safety with regard to a timely shutdown in the event of overheating of the cooking appliance can be taken into account since the coupling switches are present in a redundant number.

The limiting temperature is preferably between about 120° C. and about 250° C., in particular between about 150° C. and about 200° C. In particular, the limiting temperature is around 170° C.

The safety switch can preferably be a thermal fuse, for example, a bimetal switch. So-called Klixons are known in this context.

In a method for preventing overheating of a cooking appliance according to the invention, the cooking appliance comprises a circuit arrangement comprising a power circuit and a control circuit. At least one heating element is connected in the power circuit and at least one coupling switch is controlled by the control circuit. The control circuit is electrically coupled to the power circuit by means of the coupling switch. An essential idea of the invention is that a safety switch is connected into the control circuit, said safety switch being actuated depending on the temperature in the cooking appliance and when a limiting temperature is exceeded, the power supply to the heating element via the power circuit is interrupted. Overheating of a cooking appliance can thus be prevented in an inexpensive and reliable manner.

Advantageous embodiments of the circuit arrangement according to the invention can also be seen as advantageous embodiments of the method according to the invention.

The invention is explained hereinafter with reference to a schematic drawing. The single FIG. 1 shows a circuit arrangement according to the invention for preventing overheating of a cooking appliance.

In the exemplary embodiment, the circuit arrangement 1 is arranged in an electric cooker. The electric cooker comprises an oven and a plurality of hotplates. The circuit arrangement 1 comprises a power circuit in which power can be transferred to heating elements 11 to 14 via electric leads L1 and L2. In the power circuit (high-voltage circuit) voltages of about 240 V (for example, in Germany) or up to about 400 V (for example, USA) are applied to the heating elements 11 to 14. In the exemplary embodiment, the first heating element 11 is designed for a heating power of about 3.6 kW, the second heating element 12 is designed for a heating power of about 1.4 kW, the third heating element 13 is designed for a heating power of about 1.1 kW and the fourth heating element 14 is designed for a heating power of about 2.1 kW.

In the exemplary embodiment, the heating element 11 shown symbolically is embodied to produce a top heat in the oven of the electric cooker. Similarly, the second heating element 12 is also designed to produce this type of top heat in the oven. The third heating element 13 is designed to produce bottom heat in the oven. In addition, the fourth heating element 14 is designed to produce air-circulating heat in the oven of the electric cooker.

In addition to the power circuit, the circuit arrangement 1 comprises a separate control circuit in which seven coupling switches 21 to 27 are connected in the exemplary embodiment. In the exemplary embodiment, the coupling switches 21 to 27 are embodied as relays. The control circuit is electrically coupled to the power circuit via these coupling switches 21 to 27. The coupling switches 21 to 27 comprise coils 21*a* to 27*a* which are connected into the control circuit. As can be seen from the diagram in FIG. 1, switching contacts 21*b* to 27*b* are connected into the power circuit. The coupling switches 21 to 27 actuate the respectively allocated switching contacts 21*b* to 27*b* whereby electrical coupling can be effected between the control circuit and the power circuit.

In the exemplary embodiment, the coupling switches 21 to 27 are electrically connected to a driver unit 3. The driver unit 3 is also connected into the control circuit of the circuit arrangement 1. In addition, the driver unit 3 is electrically connected to a control unit 4, for example, a microprocessor. In addition, the driver unit 3 is connected to earth.

In the exemplary embodiment, the coupling switches 21 to 24 can be controlled for synchronised power output to respectively allocated heating elements 11 to 14. A corresponding coupling switch 21 to 24 is therefore allocated to each of the heating elements 11 to 14. These coupling switches 21 to 24 are controlled by means of the control unit 4 and the driver unit 3. In this case, it can be provided that, for example, when the cooking appliance is operating normally, power can be applied to at least one of the heating elements 11 to 14 for a duration which can be predetermined. For example, power can be applied to all four heating elements 11 to 14 for a duration of 30 seconds in such a manner that each of the heating elements 11 to 14 produces a temperature of about 200° Celsius. After these 30 seconds have elapsed, the power supply to the heating elements 11 to 14 is interrupted by triggering the coupling switches 21 to 24 in such a manner that the switching contacts 21*b*, 22*b*, 23*b* and 24*b* are opened and the power supply to the heating elements 11 to 14 via the power circuit is interrupted.

In addition, a further coupling switch 25 is allocated to the first heating element 11. A further coupling switch 26 is allocated to the heating elements 12 and 13. In addition, a further coupling switch 27 is allocated to the heating element 14. In the exemplary embodiment, therefore two coupling switches are allocated to each of the heating elements 11 to 14, thereby forming a redundant system of coupling switches 21 to 27. It can thus be ensured during normal operation that even if, for example, the coupling switch 21 does not function correctly, the power supply to the heating element 11 is interrupted by the coupling switch 25 in which the switching contact 25*b* is opened. In the exemplary embodiment, the coupling switches 25 to 27 can be controlled in such a manner that the operating mode or the heating mode of the heating elements 11 to 14 is adjustable. It should be noted that the redundant design of the coupling switches is not absolutely necessary and the coupling switches 21 to 24 would already be sufficient for the fundamental operating mode.

In the exemplary embodiment, normal operation of the cooking appliance is characterised by the control unit 4 and the driver unit 3 as well as the coupling switches 21 to 24 and/or the coupling switches 25 to 27 functioning correctly and free from error.

In the exemplary embodiment a DC voltage of around 9.6 V is applied to the control circuit via the lead 6.

As can be seen in the diagram in FIG. 1, a safety switch 5 is connected into the control circuit, said safety switch being shown open in the diagram in FIG. 1. In the exemplary embodiment, the safety switch 5 is embodied as a bimetal switch. The safety switch 5 is thus electrically connected to the coils 21*a* to 27*a* of the coupling switches 21 to 27.

During normal operation of the circuit arrangement 1 and therefore during normal operation of the cooking appliance, the safety switch 5 is closed. The power supply to the heating elements 11 to 14 is controlled correctly and free from error by the control and/or regulation system and thus by opening or closing the coupling switches 21 to 27 by means of the control unit 4 and the driver unit 3. If a malfunction of the control unit 4 and/or the driver unit 3 and/or temperature sensors of the heating elements 11 to 14, which are not shown, now occurs, normal operation is no longer provided. This is also no longer provided if respectively two coupling switches 21 to 27 allocated to a heating element 11 to 14 can no longer be controlled free from error. Thus, for example, normal operation is also no longer ensured when the coupling switches 21 and 25 which are allocated to the heating element 11 can no longer be actuated in such a manner that any overheating of the heating element 11 can be prevented. The same applies for the heating elements 12 to 14 and the respectively allocated coupling switches 22, 23, 24, 26 and 27.

If normal operation is no longer provided, the safety switch 5 is opened after a predetermined limiting temperature is exceeded. As a result, the power supply to all the coils 21*a* to 27*a* of the coupling switches 21 to 27 can be interrupted. As a consequence, the switching contacts 21*b* to 27*b* are opened and the power supply to the heating elements 11 to 14 via the power circuit is interrupted. Any overheating of the heating elements 11 to 14 and thus also of the cooking appliance can thus be reliably prevented.

In the exemplary embodiment, the limiting temperature at which the safety switch 5 is opened or triggered is around 170° C. The safety switch 5 therefore directly switches the coupling switches 21 to 27 and in particular the coils 21*a* to 27*a*. Direct switching of the elements 11 to 14 in the power circuit is no longer executed as in the prior art. As a result, overheating of the cooking appliance can be reliably prevented even when normal operation of the cooking appliance can no longer be ensured.

The invention claimed is:

1. A circuit arrangement for preventing overheating of a cooking appliance, comprising:

a power circuit in which at least one heating element is connected;

a control circuit;

at least one coupling switch, the control circuit and the power circuit being coupled by means of the at least one coupling switch and the control circuit being operable to control the at least one coupling switch; and a safety switch connected into the control circuit, the safety switch being actuable as a function of a temperature in the cooking appliance in such a manner that, when a limiting temperature in the cooking appliance is exceeded, the power supply via the power circuit to the heating element is interrupted by the at least one coupling switch, wherein the current in the control circuit is lower than the current in the power circuit.

2. The circuit arrangement according to claim 1, wherein the coupling switch is embodied as a relay.

3. The circuit arrangement according to claim 1, wherein the at least one coupling switch and another switch are connected into the control circuit and the control circuit is connected to the power circuit via the two coupling switches.

4. The circuit arrangement according to claim 3, wherein, when the cooking appliance is operating normally, the two coupling switches can be controlled via a control unit and individual operation of the heating element can be adjusted depending on the control of the coupling switch.

5. The circuit arrangement according to claim 4, wherein the control unit is connected into the control circuit.

6. The circuit arrangement according to claim 1, wherein the safety switch is electrically connected to a coil of the at least one coupling switch and the power supply to the coil can be controlled depending on the actuation of the safety switch.

7. The circuit arrangement according to claim 6, wherein a switching contact of the at least one coupling switch is connected into the power circuit and can be actuated in such a manner than when the limiting temperature is exceeded, the switching contact is opened, by opening the safety switch and interrupting the power supply to the coil.

8. The circuit arrangement according to claim 1, wherein the limiting temperature lies in a selected one of a range between about 120° C. and about 250° C., a range between about 150° C. and about 200° C., and a range around 170° C.

9. The circuit arrangement according to claim 1, wherein the safety switch is a bimetal switch.

10. A method for preventing overheating of a cooking appliance, the method comprising:

in a cooking appliance having a power circuit in which at least one heating element is connected, a control circuit, at least one coupling switch with the control circuit and the power circuit being coupled by means of the at least one coupling switch and the control circuit being operable to control the at least one coupling switch, and a safety switch connected into the control circuit, actuating the safety switch as a function of a temperature in the cooking appliance in such a manner that, when a limiting temperature in the cooking appliance is exceeded, the power supply via the power circuit to the heating element is interrupted by the at least one coupling switch, wherein the current in the control circuit is lower than the current in the power circuit.

11. A circuit for preventing overheating of a cooking appliance, comprising:

a power circuit with a heating element;

a coupling switch operable to open the power circuit to interrupt the current in the power circuit; and a control circuit with a safety switch that controls the coupling switch to open the power circuit in response to a temperature exceeding a predetermined temperature, wherein the current in the control circuit is lower than the current in the power circuit.

* * * * *